US009510082B2

(12) United States Patent
Niu et al.

(10) Patent No.: US 9,510,082 B2
(45) Date of Patent: Nov. 29, 2016

(54) EARPHONE VIBRATOR DETECTION DEVICE, SYSTEM AND METHOD

(71) Applicant: Qingdao Goertek Technology Co., Ltd., Qingdao, ShanDong (CN)

(72) Inventors: Xiliang Niu, Qingdao (CN); Jun Zhang, Qingdao (CN)

(73) Assignee: QINGDAO GOERTEK TECHNOLOGY CO., LTD., Qingdao, Shandong (CN)

( * ) Notice: Subject to any disclaimer, the term of this patent is extended or adjusted under 35 U.S.C. 154(b) by 0 days.

(21) Appl. No.: 14/441,350

(22) PCT Filed: Nov. 11, 2013

(86) PCT No.: PCT/CN2013/087341

§ 371 (c)(1),
(2) Date: May 7, 2015

(87) PCT Pub. No.: WO2014/075639

PCT Pub. Date: May 22, 2014

(65) Prior Publication Data

US 2015/0271589 A1 Sep. 24, 2015

(30) Foreign Application Priority Data

Nov. 19, 2012 (CN) ..... 2012 1 0468847

(51) Int. Cl.
*H04R 29/00* (2006.01)
*H04R 1/10* (2006.01)
*H04R 5/033* (2006.01)

(52) U.S. Cl.
CPC ..... *H04R 1/1091* (2013.01); *H04R 29/00* (2013.01); *H04R 29/002* (2013.01); *H04R 5/033* (2013.01)

(58) Field of Classification Search
CPC ..... H04S 7/303; H04S 7/304; H04R 29/00; H04R 29/001; H04R 29/003; H04R 25/30; H04R 25/305; H04R 31/006; H04R 2231/003
See application file for complete search history.

(56) References Cited

U.S. PATENT DOCUMENTS

2012/0002822 A1* 1/2012 Peissig ..... G06F 3/012 381/74
2013/0223640 A1* 8/2013 Urano ..... H04R 3/00 381/74

FOREIGN PATENT DOCUMENTS

| | | |
|---|---|---|
| CN | 103024655 | 4/2013 |
| CN | 202957981 | 5/2013 |
| WO | 9513690 | 5/1995 |

OTHER PUBLICATIONS

PCT/CN2013/087341, Written Opinion the International Searching Authority dated Mar. 6, 2014; 4 pages and English Translation, 4 pages.

*Primary Examiner* — Duc Nguyen
*Assistant Examiner* — Kile Blair
(74) *Attorney, Agent, or Firm* — Boyle Fredrickson, S.C.

(57) ABSTRACT

The present invention discloses an earphone vibrator detection device, system and method. The device of the present invention is suitable for detecting a headset vibrator, and being placed at the headband position of the headset during detection. The device comprises an acceleration sensor and a signal conversion module mutually connected; the acceleration sensor is configured to detect the acceleration information of the headband position when the headset outputs a specified audio, and convert the acceleration information into a voltage signal to be output to the signal conversion module; and the signal conversion module is configured to convert the received voltage signal into a digital signal to be output, so as to determine whether the vibration amplitude of the headset vibrator is qualified according to the output digital signal. The technical solution of the present invention solves the problem that the detection of a headset vibrator is currently conducted manually in a cumbersome and laborious manner.

10 Claims, 3 Drawing Sheets

EARPHONE VIBRATOR DETECTION DEVICE, SYSTEM AND METHOD

TECHNICAL FIELD

The present invention relates to the technical field of detecting earphone performance, in particular relates to a device, a system and a method for detecting an earphone vibrator.

BACKGROUND ART

Detection of earphone performance includes detecting earphone vibrator, mainly detecting the vibration amplitude of earphone vibrator. The vibration amplitude of the earphone vibrator should be neither too large nor too small, should be within a certain standard range.

Currently, the detection of earphone vibrator can only be conducted in a manually determination way, the quality of earphone vibrator is determined according to the experience of an inspector. Such a manually detecting way not only requires a lot of manpower, but also making deviation existing in the quality of products, because the detection is conducted according to personal experience, without uniform standard.

To sum up, the current earphone vibrator detection is required to be conducted manually, has a problem of being cumbersome and laborious, and the quality of products cannot be assured uniformly because there exists human factor.

SUMMARY OF THE INVENTION

The present invention provides an earphone vibrator detection device, system and method, to solve the problems that the current earphone vibrator detection is conducted manually in a cumbersome and laborious manner and the quality of products cannot be assured.

To achieve the above object, the technical solution of the present invention is achieved as follows: the present invention discloses an earphone vibrator detection device, said device is placed at the headband of a headset during detection, the device comprises an acceleration sensor and a signal conversion module mutually connected, wherein, the acceleration sensor is configured to detect the acceleration information of the headband position when the headset outputs a specified audio, and convert the acceleration information into a voltage signal to be output to the signal conversion module;

the signal conversion module is configured to convert the received voltage signal into a digital signal to be output, so as to determine whether the vibration amplitude of the headset vibrator is qualified according to the output digital signal.

The present invention further discloses an earphone vibrator detection system, the system comprises a control terminal and the aforesaid headset vibrator detection device, the control terminal is connected to the signal conversion module in the earphone vibrator detection device;

the control terminal is configured to receive the digital signal output by the signal conversion module, calculate the vibration amplitude of the headband position of the headset according to the digital signal, and determine whether the vibration amplitude of the headset vibrator is qualified according to the relationship between the vibration amplitude of the headband position of the headset and the vibration amplitude of the headset vibrator.

In the aforesaid system, the acceleration sensor is configured to detect the acceleration information of the headband position in the directions of x, y and z axes when the headset outputs the specified audio, and convert the acceleration information in the directions of x, y and z axes into the voltage signal in the corresponding directions of x, y and z axes to be output to the signal conversion module;

the signal conversion module is configured to convert the voltage signal in the directions of x, y and z axes into the digital signal in the corresponding directions of x, y and z axes, and deliver the digital signal in the corresponding directions of x, y and z axes to the control terminal;

the control terminal is configured to receive the digital signal in the corresponding directions of x, y and z axes output by the signal conversion module, and calculate the vibration amplitude of the headband position of the headset in the corresponding directions of x, y and z axes respectively according to the digital signal in the directions of x, y and z axes within a specified time limit;

wherein, the y axis direction is a horizontal direction paralleling to the straight line determined by connecting two earphone vibrators;

the x axis direction is a horizontal direction vertical, to the straight line determined by connecting the two earphone vibrators;

the z axis direction is a vertical direction vertical to the straight line determined by connecting to earphone vibrators.

In the aforesaid system, the control terminal is configured to determine the headset vibrator is qualified when the calculated vibration amplitude of the headband position in the x axis is within a first specified range, the calculated vibration amplitude in the y axis is within a second specified range and the calculated vibration amplitude in the z axis is within a third specified range.

In the aforesaid system, the control terminal is further configured to determine one of the vibrators of headset is reversely installed when the calculated vibration amplitude of the headband position in the y axis is larger than the maximal value of the second specified range and the calculated vibration amplitude in the z axis is less than the minimal value of the third specified range.

In the aforesaid system, the signal conversion module of the earphone vibrator detection device is connected to the control terminal via a data wire, or, the signal conversion module of the earphone vibrator detection device is connected to the control terminal in a wireless way.

The aforesaid system further comprises a workstand for placing the headset to be detected;

the workstand comprises a left side plate, a right side plate and a bottom plate, the left side plate and right side plate arc fixed on the bottom plate respectively.

The present invention further discloses an earphone vibrator detection method, said method comprises: placing a headset onto a workstand, placing the earphone vibrator detection device at the headband of the headset, connecting the earphone vibrator detection device to the control terminal;

the earphone vibrator detection device converting the acceleration information of the headband position into a digital signal when the headset outputs a specified audio, then delivering the digital signal to the control terminal;

the control terminal calculating the vibration amplitude of the headband position of the headset according to the digital signal, and determining whether the vibration amplitude of the headset vibrator is qualified according to the relationship between the vibration amplitude of the headband position of the headset and the vibration amplitude of the headset vibrator.

In the aforesaid method, the earphone vibrator detection device converting the acceleration information of the headband position into the digital signal when the headset outputs the specified audio, then delivering the digital signal to the control terminal comprises: the earphone vibrator detection device detecting the acceleration information in the directions of x, y and z axes of the headband position when the headset outputs the specified audio, and converting the acceleration information in the directions of x, y and z axes into the digital signal in the corresponding directions of x, y and z axes, then delivering the digital signal to the control terminal.

the control terminal calculating the vibration amplitude of the headband position of the headset according to the digital signal, and determining whether the vibration amplitude of the headset vibrator is qualified according to the relationship between the vibration amplitude of the headband position of the headset and the vibration amplitude of the headset vibrator comprises:

the control terminal receiving the digital signal in the corresponding directions of x, y and z axes delivered by the earphone vibrator detection device; calculating the vibration amplitude of headband position in the corresponding directions of x, y and z axes according to the digital signal respectively;

and determining the headset vibrator is qualified when the calculated vibration amplitude of the headband position in the x axis is within a first specified range, the calculated vibration amplitude in the y axis is within a second specified range and the vibration amplitude in the z axis is within a third specified range.

The aforesaid method further comprises: determining one of the vibrators of headset is reversely installed when the calculated vibration amplitude of the headband position in the y axis is larger than the maximal value of the second specified range and the calculated vibration amplitude in the z axis is less than the minimal value of the third specified range.

Thus, it is seen that the technical solution provided by the present invention determines whether the vibration amplitude of the headset vibrator is qualified according to the relationship between the vibration amplitude of the headband position of headset and the vibration amplitude of headset vibrator by placing the acceleration sensor at the headband of the headset, the acceleration sensor delivering the detected acceleration information to the signal conversion module, the signal conversion module converting the acceleration information into the digital signal, then delivering the digital signal to the control terminal, the control terminal calculating the vibration amplitude of the headband position of headset according to the received digital signal in the corresponding directions of x, y and z axes. Furthermore, it can determine whether one of the vibrators of headset is reversely installed according to the detected vibration amplitude of the headband position of the headset, The technical solution provided by the present invention does not make any change to the product, it can calculate the vibration amplitude of the headband position by detecting the acceleration of headband position of the headset, then deduce whether the vibration amplitude of the earphone vibrator is qualified according to the relationship between the vibration amplitude of the headband position and the vibration amplitude of the earphone vibrator, it can determine the measurement result correctly, improve the efficiency and effect of detection, and prevent the non-standardized measurement condition caused by human factor.

DETAILED DESCRIPTION OF THE INVENTION

Figure 1:
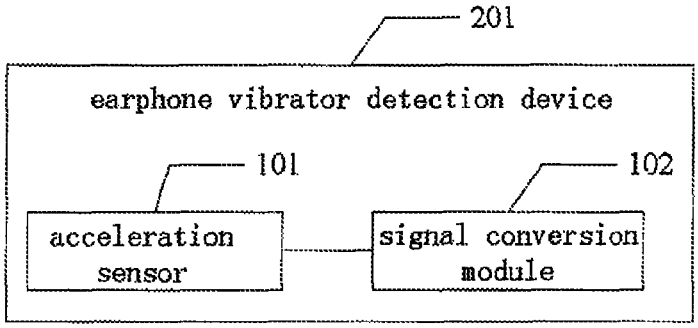
FIG. 1 is a schematic structural diagram of an earphone vibrator detection device of the present invention.

To make the purpose, technical solution and advantages of the present invention clearer, the embodiments of the present invention will be further described in details with reference to the drawings.

The principle of the present invention is: the vibrators of headset are installed in left and right earcups of the headset, and when an audio signal is input, the two vibrators vibrate in horizontally opposite directions, thus the arched headband of headset will move up and down. The headband herein refers to the part connecting two earcups, also referring to a headwear. The vibrators will vibrate according to the input audio signal, meanwhile cause the whole headset to vibrate, and the vibration amplitude of the headband position is the largest. The larger the vibration amplitude of the earphone vibrator is, the larger the vibration amplitude of the headband position is, and under the same frequency, the larger the vibration amplitude of the headband position is, the larger the acceleration of headband position is, that is to say, the acceleration of the headband position is proportional to the vibration amplitude of the vibrator. Therefore, in the present invention, the vibration amplitude of the headband position of headset is detected indirectly by detecting the acceleration of headband position, the vibration condition of the headset vibrator is determined by the vibration amplitude of the headband position.

The core of the present invention is that: the headset is disposed onto the workstand for fixing the headset, the earphone vibrator detection device comprising an acceleration sensor and a signal conversion module is placed at the headband of the headset, in condition that the audio signal with same frequency is input (i.e., when detecting the same type of headset vibrator, the input audio of each headset to be detected is ensured to be the same), the acceleration sensor converts the collected acceleration information into a voltage signal to be delivered to the signal conversion module, then the signal conversion module converts the voltage signal into a digital signal then delivers the digital signal to the control terminal. The control terminal determines the vibration amplitude of the headband position of headset according to the digital signal, so as to determine the vibration condition of the headset vibrator. if the detected vibration amplitude of the headband position is less than a predetermined lower threshold value, the vibration amplitude of the headset vibrator is considered to be relatively small: and if the detected vibration amplitude of the headband position is more than a predetermined higher threshold value, the vibration amplitude of the headset vibrator is considered to be too large.

The present invention provides an earphone vibrator detection device, the earphone vibrator detection device is used to detect whether the vibration amplitude of the headset vibrator meets the standard, and said device is placed at the headband of the headset during detection.

FIG. 1 is a schematic structural diagram of an earphone vibrator detection device of the present invention. As shown in FIG. 1, the earphone vibrator detection device 201 comprises: an acceleration sensor 101 and a signal conversion module 102 mutually connected. The device is placed at the headband of the headset during detecting the headset vibrator.

The acceleration sensor 101 is configured to detect the acceleration information of the headband position when the headset outputs a specified audio, and convert the acceleration information into a voltage signal to be output to the signal conversion module 102.

The signal conversion module 102 is configured to convert the received voltage signal into a digital signal to be output, so as to determine whether the vibration amplitude of the headset vibrator is qualified according to the output digital signal.

The headset vibrator detection device provided in the present invention is able to detect the acceleration information of the headband position of the headset, and convert the detected acceleration information into a corresponding digital signal then output the digital signal, such that the control terminal connected therewith can determine whether the vibration amplitude of the headset vibrator is qualified according to the digital signal.

Figure 2:
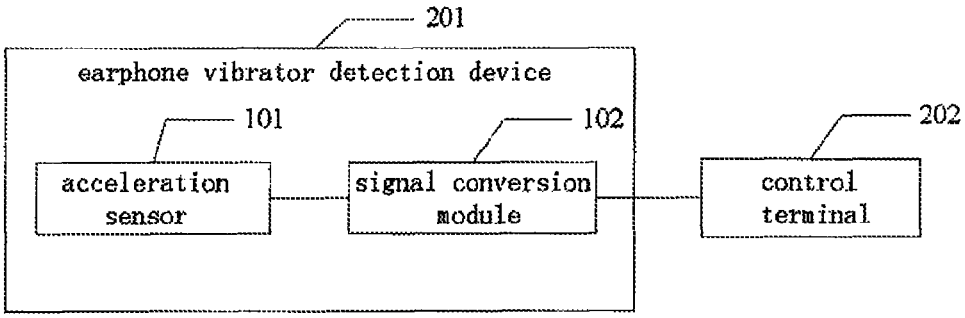
FIG. 2 is a schematic structural diagram of an earphone vibrator detection system of the present invention.

The present invention further provides an earphone vibrator detection system. FIG. 2 is the schematic structural diagram of an earphone vibrator detection system of the present invention. As shown in FIG. 2, the system comprises a control terminal 202 and the earphone vibrator detection device 201 as shown in FIG. 1. The control terminal 202 is connected to the signal conversion module 102 in the earphone vibrator detection device 201.

The control terminal 202 is configured to receive the digital signal output by the signal conversion module 102, and determine whether the vibration amplitude of the headset vibrator is qualified according to the digital signal.

Figure 3:
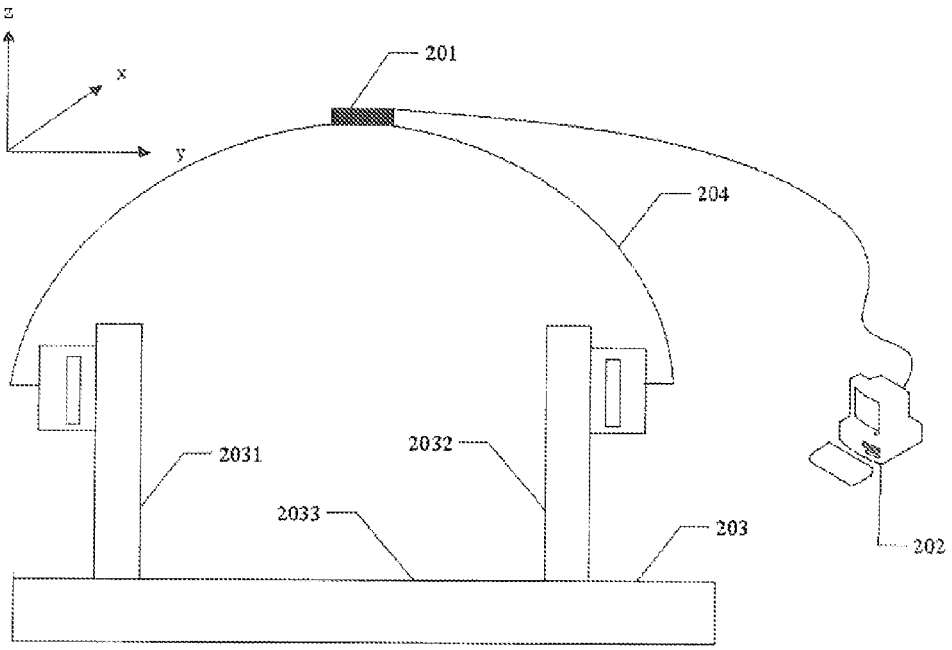
FIG. 3 is a diagram of an earphone vibrator detection system of the present invention in use status.

FIG. 3 is a diagram of an earphone vibrator detection system of the present invention in use status. As shown in FIG. 3, for the convenience of description, the directions of x, y and z axes are defined respectively, wherein y axis direction is a horizontal direction paralleling to the straight line determined by connecting two earphone vibrators; x axis direction is a horizontal direction vertical to the straight line determined by connecting two earphone vibrators, i.e., x axis and y axis are vertical to each other on the same horizontal plane; z axis direction is a vertical direction vertical to the straight line determined by connecting two earphone vibrators, i.e., z axis is vertical to the horizontal plane determined by x axis and y axis.

The earphone vibrator detection device 201 comprising the acceleration sensor 101 and the signal conversion module 102 is placed at the headband of the headset 204. The acceleration sensor 101 in the earphone vibrator detection device 201 detects the acceleration information of the headband position in the directions of x, y and z axes when the headset 204 outputs a specified audio, and converts the detected acceleration information in the corresponding directions of x, y and z axes into the voltage signal in the corresponding directions of x, y and z axes to be output to the signal conversion module 102. To detect the maximal vibration amplitude, the earphone vibrator detection device 201 is placed at the middle position of the arched headband of the headset 204.

The input end of the signal conversion module 102 is connected to the acceleration sensor 101, and its output end is connected to the control terminal 202. The signal conversion module 102 converts the voltage signal in the directions of x, y and z axes output by the acceleration sensor 101 into the digital signal in the corresponding directions of x. y and z axes. and delivers the digital signal in the corresponding directions of x, y and z axes to the control terminal 202.

The control terminal 202 is configured to receive the digital signal in the corresponding directions of x, y and z axes delivered by signal conversion module 102, and calculate the vibration amplitude of headband position of headset 204 in the corresponding directions of x, y and z axes respectively according to the digital signal in the directions of x. y and z axes within a specified time limit. Since the acceleration value is proportional to the vibration amplitude, the control terminal 202 can calculate the vibration amplitude of the headband position of the headset 204 in the directions of x, y and z axes respectively by obtaining the digital signal of x, y and z axes within the specified time limit.

In the embodiment of the present invention, the control terminal 202 determines whether the vibration condition of the vibrator of headset 204 is normal by comparing with a predetermined value range according to the calculated vibration amplitude of the headband position of headset 204 in the directions of x, y and z axes: the vibrator amplitude is within a normal value range, is too large or is too small. This is because, there is correlation between the vibration amplitude of the earphone vibrator and the vibration amplitude of the headband, and it is possible to deduce whether the vibration amplitude of the vibrator is within a range of qualified vibrator amplitude from the vibration amplitude of the headband based on the correlation.

The control terminal 202 is configured to determine the vibrator of headset 204 is qualified when the vibration amplitude in the x axis is within a first specified range, the vibration amplitude in the y axis is within a second specified range and the vibration amplitude in the z axis is within a third specified range. The first specified range, second specified range and third specified range can be determined according to actual condition. In the other embodiments of the present invention, it is possible to determine whether the amplitude of the vibrator of the headset 204 is qualified, too large or too small merely by whether the vibration amplitude in the z axis is within a third specified range.

During actual measurement process, with regard to a batch of headset of same type, the audio signal with same frequency is input, and the first specified range, second specified range and third specified range are determined with regards to the headset 204 of the same batch according to actual condition. Different type of headsets 204 have different values of a first specified range, a second specified range and a third specified range, due to the difference in the specific shape and texture of arched headband thereof.

Wherein since the two vibrators in a headset vibrate in opposite directions, in condition that they are installed correctly, the vibration amplitude in the z axis is the largest, and the vibration amplitude in the x axis and the y axis is slight. When one of the vibrators in the headset is installed reversely, the vibration amplitude in the y axis will increase largely, the vibration amplitude in the z axis will decrease largely. Therefore, the device provide by the present invention can further be used to detect whether the vibrator of headset 204 is reversely installed. It should be note that the vibrator being reversely installed refers to the condition that one of the two vibrators is reversely installed.

Therefore, the control terminal 202 is further configured to determine one of the vibrators of the headset 204 is reversely installed when the vibration amplitude in the y axis is larger than the maximal value of the second specified range and the vibration amplitude in the z axis is less than the minimum value of the third specified range. Specifically, if a certain earphone vibrator is installed reversely, the acceleration in the y axis direction detected by the acceleration sensor 101 will increase, the acceleration in the z axis direction will decrease, and correspondingly, the vibration amplitude in the y axis direction calculated by the control terminal 202 will increase, the vibration amplitude in the z axis direction will decrease, then it can be determined that one of the vibrators of the headset 204 is reversely installed.

In the specific embodiment of the present invention, the signal conversion module 102 of the earphone vibrator detection device 201 is connected to the control terminal 202 via a data wire, for example, the signal conversion module 102 can be connected to the control terminal 202 via a USB date wire. Alternatively, the signal conversion module 102 of the earphone vibrator detection device 201 is connected to the control terminal 202 in a wireless way, for example, the signal conversion module 102 can be connected to the control terminal 202 in a wireless way such as Bluetooth.

To detect the acceleration information of the headband position more correctly when headset 204 outputs a specified audio, the system further comprises: a workstand 203 for placing the headset 204 to be detected.

As shown in FIG. 3, the workstand 203 comprises: a left side plate 2031, a right side plate 2032 and a bottom plate 2033, the left side plate 2031 and right side plate 2032 are fixed on the bottom plate 2033 respectively.

In addition, the workstand 203 may further comprise an earphone fixation component to fix and locate each earphone to be detected. For example, a symmetrical fixation component (such as groove or slot etc.) for fixing the earcup of the headset is disposed on the left side plate 2031 and the right side plate 2032 respectively. In addition, to ensure the uniform position of the earphone vibrator detection device 201 on the headband, the position of the earphone vibrator detection device 201 on the headband is localized by a gradienter to ensure each detect ion data is comparable.

In an embodiment of the present invention, the control terminal 202 may comprise a control key for controlling ON or OFF of the control terminal 202. The control terminal may further comprise an indication light for indicating whether the earphone is qualified; wherein the control terminal 202, after detecting a headset, controls the indication light to output corresponding indication information according to the detection result. For example, flickering of red light represents that the detected headset vibrator is unqualified; flickering of green light represents that the detected headset vibrator is qualified, and too large or too small vibration amplitude can be represented by constant lighting or flicking, The control terminal can also comprise a display screen for displaying the vibration amplitude in the corresponding directions of x axis, y axis and z axis calculated by the control terminal 202 according to the digital signal in x, y and z axes delivered by signal conversion module 102, and for displaying detection result.

Figure 4:
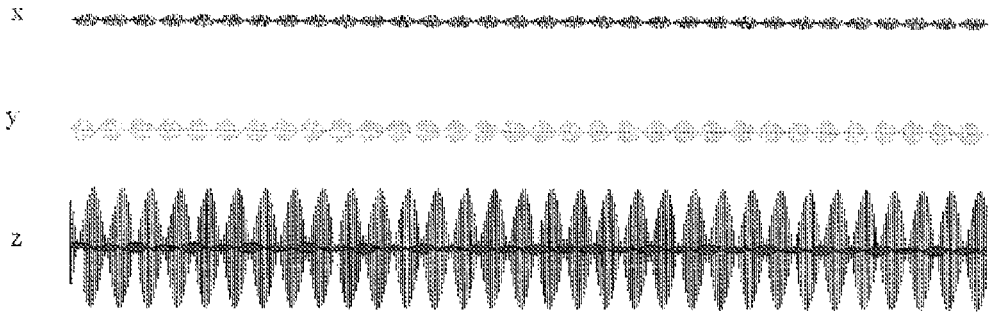
FIG. 4 is a schematic diagram of the vibration amplitude of the headband position when the headset vibrator is installed correctly.
Figure 5:
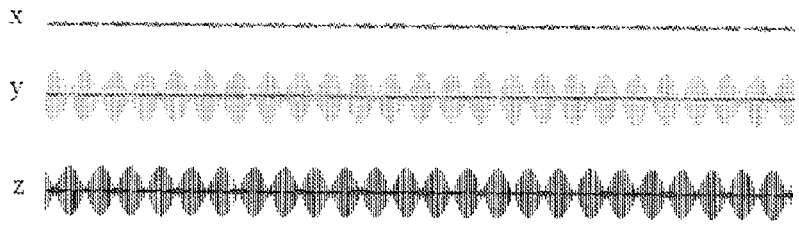
FIG. 5 is a schematic diagram of the vibration amplitude of the headband position when one of the vibrators of headset is reversely installed.

Hereinafter, a specific embodiment of the present invention will be described in detail in which, as an example, 100 Hz sine wave signal is input. FIG. 4 is a schematic diagram of the vibration amplitude of the headband position when the headset vibrator is installed correctly; FIG. 5 is a schematic diagram of the vibration amplitude of the headband position when one of the vibrators of headset is reversely installed.

As shown in FIG. 4 and FIG. 5, the upper waveform represents the vibration amplitude in the x axis, the middle waveform represents the vibration amplitude in the y axis, the lower waveform represents the vibration amplitude in the z axis. The control terminal 202 calculates the vibration amplitude of the headband of headset 204 in the corresponding directions of x, y and z axes respectively according to the digital signal in the directions of x, y and z axes within 5 seconds.

In FIG. 4, the maximal vibration amplitude in the x axis is 223, the maximal vibration amplitude in the y axis is 438, the maximal vibration amplitude in the z axis is 2126. In FIG. 5, the maximal vibration amplitude in the x axis is 58, the maximal vibration amplitude in the y axis is 910, the maximal vibration amplitude in the z axis is 826.

Referring to FIG. 4, in condition that the vibrator of headset 204 is installed correctly, the vibration amplitude in the z axis is the largest, the effect in the directions of x axis and y axis is slight, so the vibration amplitude in the x axis and the y axis is smaller. Referring to FIG. 5, when one of the vibrators of the headset 204 is reversely installed, the vibration amplitude in the z axis decreases, the vibration amplitude in the y axis increases. In addition, whether the vibration amplitude of the vibrator of the headset 204 is too large or too small, is determined by whether the vibration amplitude of the headband of the correctly installed headset 204 in the directions of x axis, y axis and z axis is within a specified range. For example, when the vibration amplitude in the x axis is within a value range of 200-300, the vibration amplitude in the y axis is within a value range of 400-500, and the vibration amplitude in the z axis is within a value range of 2000-2400, the headset vibrator is regarded as qualified.

The wave diagrams shown in FIG. 4 and FIG. 5 can be displayed on the display screen of the control terminal.

The present invention further provides an earphone vibrator detection method, the method detects the headset vibrator by using the earphone vibrator detection device provided by the present invention.

Figure 6:
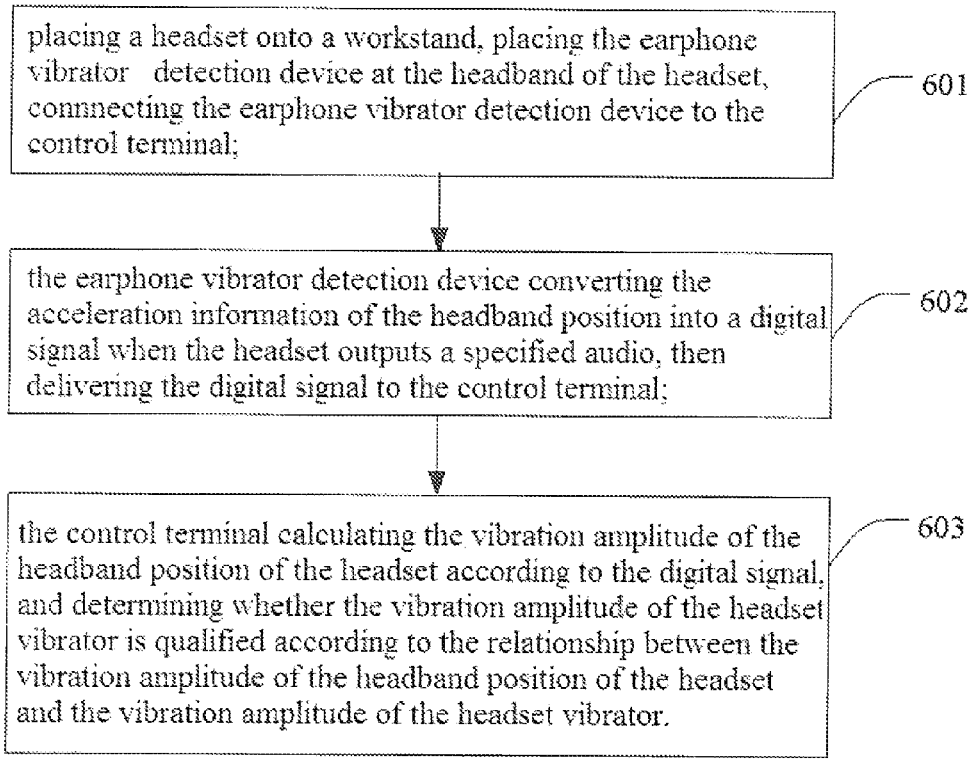
FIG. 6 is a flowchart of an earphone vibrator detection method of the present invention.

FIG. 6 is a flowchart of an earphone vibrator detection method of the present invention; as shown in FIG. 6.

step 601: placing the headset onto the workstand, disposing the earphone vibrator detection device at the headband of the headset, connecting the earphone vibrator detection device connected to the control terminal.

Step 602: the earphone vibrator detection device converting the acceleration information of the headband position into a digital signal when the headset outputs a specified audio, then delivering the digital signal to the control terminal.

Step 603: the control terminal calculating the vibration amplitude of the headband position of the headset according to the digital signal, and determining whether the vibration amplitude of the headset vibrator is qualified according to the relationship between the vibration amplitude of the headband position of the headset and the vibration amplitude of the headset vibrator.

In the earphone vibrator detection method provided by the present invention, the earphone vibrator detection device converting the acceleration information of the headband position into a digital signal when the headset outputs a specified audio, then delivering the digital signal to control terminal comprises: the earphone vibrator detection device detecting the acceleration information of the headband position in the directions of x, y and z axes when the headset outputs the specified audio, and converting the acceleration information in the directions of x, y and z axes into the digital signal in the corresponding directions of x, y and z axes, then delivering the digital signal to the control terminal;

the control terminal determining whether the vibration amplitude of the headset vibrator is qualified according to the digital signal comprises: the control terminal receiving the digital signal in the corresponding directions of x, y and z axes delivered by the earphone vibrator detection device;

calculating the vibration amplitude in the corresponding directions of x, y and z axes respectively according to the digital signal;

determining that the headset vibrator is qualified when the vibration amplitude in the x axis is within a first specified range, the vibration amplitude in the y axis is within a second specified range and the vibration amplitude in the z axis is within a third specified range.

In the aforesaid method, the method provided by the present invention can further be used to detect whether one of the vibrators of the headset is reversely installed. Specifically, one of the vibrators of the headset is determined to be reversely installed when the vibration amplitude in the y axis is larger than the maximal value of the second specified range and the vibration amplitude in the z axis is less than the minimal value of the third specified range.

To sum up, the technical solution provided by the present invention determining whether the vibration amplitude of the headset vibrator is qualified by disposing the acceleration sensor at the headband of the headset, the acceleration sensor delivering the detected acceleration information to the signal conversion module, the signal conversion module converting the acceleration information into a digital signal to be delivered to the control terminal, the control terminal calculating the vibration amplitude of the headband position in the directions of x, y and z axes according to the received digital signal in the corresponding directions of x, y and z axes, and according to the relationship between the vibration amplitude of the headband position and the vibration amplitude of the vibrator. Furthermore, it can determine whether one of the vibrators of the headset is installed reversely according to the calculated vibration amplitude of the headband position of the headset. The technical solution provided by the present invention does not make any change to the product, it can determine the vibration amplitude of the headband position of the headset by detecting the acceleration of headband position, then determine whether the earphone vibrator is qualified according to the vibration amplitude of the headband position, it can determine the measurement result correctly, improve the efficiency and effect of detection, and prevent the non-standardized measurement condition caused by human factor.

The foregoing description are merely the preferable embodiments of the present invention, are not intended to limit the protection scope of the present invention. Any modification, equivalent replacement and improvement within the spirit and principle of the present invention should fall into the protection scope of the present invention.

The invention claimed is:

1. An earphone vibrator detection system, characterized in that the system comprises:

a workstand for placing a headset to be detected, a control terminal and a headset vibrator detection device;

wherein;

during detection, the headset is placed onto the workstand and the earphone vibrator defection device is placed at a headband of the headset;

the earphone vibrator detection device includes an acceleration sensor and a signal conversion module mutually connected, the control terminal is connected to the signal conversion module in the earphone vibrator detection device;

the acceleration sensor is configured to detect the acceleration information of a headband position when the headset outputs a specified audio, and converts the acceleration information into a voltage signal to be output to the signal conversion module;

the signal conversion module is configured to convert the received voltage signal into a digital signal and deliver the distal signal to the control terminal; and the control terminal is configured to receive the digital signal output by the signal conversion module, calculate the vibration amplitude of the headband position of the headset according to the digital signal, and determine whether the vibration amplitude of the headset vibrator is qualified according to the relationship between the vibration amplitude of the headband position of the headset and the vibration amplitude of the headset vibrator.

2. The system according to claim 1, characterized in that:

the acceleration sensor is configured to detect the acceleration information of the headband position in the directions of x, y and z axes when the headset outputs the specified audio, and convert the acceleration information in the directions of x, y and z axes into the voltage signal in the corresponding directions of x, y and z axes to be output to the signal conversion module;

the signal conversion module is configured to convert the voltage signal in the directions of x, y and z axes into the digital signal in the corresponding directions of x, y and z axes, and deliver the digital signal in the corresponding directions of x, y and z axes to the control terminal; and the control terminal is configured to receive the digital signal in the corresponding directions of x, y and z axes output by the signal conversion module, and calculate the vibration amplitude of the headband position of the headset in the corresponding directions of x, y and z axes respectively according to the digital signal in the directions of x, y and z axes within a specified time limit;

wherein:

the y axis direction is a horizontal direction paralleling to the straight line determined by connecting two earphone vibrators;

the x axis direction is a horizontal direction vertical to the straight line determined by connecting the two earphone vibrators; and the z axis direction is a vertical direction vertical to the straight line determined by connecting two earphone vibrators.

3. The system according to claim 2, characterized in that the control terminal is configured to determine the headset vibrator is qualified when the calculated vibration amplitude of the headband position in the x axis is within a first specified range, the calculated vibration amplitude in the y axis is within a second specified range and the calculated vibration amplitude in the z axis is within a third specified range.

4. The system according to claim 2, characterized in that the control terminal is further configured to determine one of the vibrators of the headset is reversely installed when the calculated vibration amplitude of the headband position in the y axis is larger than the maximal value of the second specified range and the calculated vibration amplitude in the z axis is less than the minimal value of the third specified range.

5. The system according to claim 1, characterized in that:

the signal conversion module of the earphone vibrator detection device is connected to the control terminal via a data wire; or the signal conversion module of the earphone vibrator detection device is connected to the control terminal in a wireless way.

6. The system according to any one of claims 1, characterized in that the workstand includes a left side plate, a right side plate and a bottom plate, the left side plate and right side plate are fixed on the bottom plate respectively.

7. An earphone vibrator detection method, the method comprising:

placing a headset onto a workstand, placing the earphone vibrator detection device at the headband of the headset, connecting the earphone vibrator detection device to the control terminal;

the earphone vibrator detection device converting the acceleration information of the headband position into a digital signal when the headset outputs a specified audio, then delivering the digital signal to the control terminal; and the control terminal calculating the vibration amplitude of the headband position of the headset according to the digital signal, and determining whether the vibration amplitude of the headset vibrator is qualified according to the relationship between the vibration amplitude of the headband position of the headset and the vibration amplitude of the headset vibrator.

8. The method according to claim 7, characterized in that:

the earphone vibrator detection device converting the acceleration information of the headband position into the digital signal when the headset outputs the specified audio, then delivering the digital signal to the control terminal comprises: the earphone vibrator detection device detecting the acceleration information in the directions of x, y and z axes of the headband position when the headset outputs the specified audio, and converting the acceleration information in the directions of x, y and z axes into the digital signal in the corresponding directions of x, y and z axes, then delivering the digital signal to the control terminal;

the control terminal calculating the vibration amplitude of the headband position of the headset according to the digital signal, and determining whether the vibration amplitude of the headset vibrator is qualified according to the relationship between the vibration amplitude of the headband position of the headset and the vibration amplitude of the headset vibrator comprises:

the control terminal receiving the digital signal in the corresponding directions of x, y and z axes delivered by the earphone vibrator detection device; calculating the vibration amplitude of headband position in the corresponding directions of x, y and z axes according to the digital signal respectively; and determining the headset vibrator is qualified when the calculated vibration amplitude of the headband position in the x axis is within a first specified range, the calculated vibration amplitude in the y axis is within a second specified range and the vibration amplitude in the z axis is within a third specified range.

9. The method according to claim 8, characterized in that the method further comprises:

determining one of the vibrators of headset is reversely installed when the calculated vibration amplitude of the headband position in the y axis is larger than the maximal value of the second specified range and the calculated vibration amplitude in the z axis is less than the minimal value of the third specified range.

10. An earphone vibrator detection device, characterized in that said device is placed at the headband of a headset during detection, the device comprises:

an acceleration sensor and a signal conversion module mutually connected; and a control terminal and a headset vibrator detection device; wherein:

the acceleration sensor is configured to detect the acceleration information of a headband position when the headset outputs a specified audio, and converts the acceleration information into a voltage signal to be output to the signal conversion module;

the signal conversion module is configured to convert the received voltage signal into a digital signal to be output, so as to determine whether the vibration amplitude of the headset vibrator is qualified according to the output digital signal;

the control terminal is connected to the signal conversion module in the earphone vibrator detection device;

the control terminal is configured to receive the digital signal output by the signal conversion module, calculate the vibration amplitude of the headband position of the headset according to the digital signal, and determine whether the vibration amplitude of the headset vibrator is qualified according to the relationship between the vibration amplitude of the headband position of the headset and the vibration amplitude of the headset vibrator;

the acceleration sensor is configured to detect the acceleration information of the headband position in the directions of x, y and z axes when the headset outputs the specified audio, and convert the acceleration information in the directions of x, y and z axes into the voltage signal in the corresponding directions of x, y and z axes to be output to the signal conversion module;

the signal conversion module is configured to convert the voltage signal in the directions of x, y and z axes into the digital signal in the corresponding directions of x, y and z axes, and deliver the digital signal in the corresponding directions of x, y and z axes to the control terminal;

the control terminal is configured to receive the digital signal in the corresponding directions of x, y and z axes output by the signal conversion module, and calculate the vibration amplitude of the headband position of the headset in the corresponding directions of x, y and z axes respectively according to the digital signal in the directions of x, y and z axes within a specified time limit;

the y axis direction is a horizontal direction paralleling to the straight line determined by connecting two earphone vibrators;

the x axis direction is a horizontal direction vertical to the straight line determined by connecting the two earphone vibrators;

the z axis direction is a vertical direction vertical to the straight line determined by connecting two earphone vibrators; and the control terminal is further configured to determine one of the vibrators of the headset is reversely installed when the calculated vibration amplitude of the headband position in the y axis is larger than the maximal value of the second specified range and the calculated vibration amplitude in the z axis is less than the minimal value of the third specified range.

* * * * *